US006866082B1

(12) United States Patent
Zahner

(10) Patent No.: US 6,866,082 B1
(45) Date of Patent: Mar. 15, 2005

(54) TEMPLATES AND KITS FOR CREATION OF HANGING PRODUCTS

(75) Inventor: David Zahner, New York, NY (US)

(73) Assignee: Zahner Design Group, Ltd., New York, NY (US)

( * ) Notice: Subject to any disclaimer, the term of this patent is extended or adjusted under 35 U.S.C. 154(b) by 0 days.

(21) Appl. No.: 10/357,287

(22) Filed: Feb. 3, 2003

Related U.S. Application Data

(60) Provisional application No. 60/353,358, filed on Feb. 1, 2002, provisional application No. 60/253,581, filed on Nov. 28, 2000, provisional application No. 60/217,747, filed on Jul. 12, 2000, provisional application No. 60/203,873, filed on May 12, 2000, provisional application No. 60/171,081, filed on Dec. 15, 1999, provisional application No. 60/150,876, filed on Aug. 26, 1999, and provisional application No. 60/143,853, filed on Jul. 15, 1999.

(51) Int. Cl.[7] ..... A47H 1/00
(52) U.S. Cl. ..... 160/390; 160/405
(58) Field of Search ..... 160/330, 348, 160/383, 384, 390, 405, DIG. 7; 33/563, 564, 566

(56) References Cited

U.S. PATENT DOCUMENTS

| | | | | | |
|---|---|---|---|---|---|
| 2,422,963 | A | * | 6/1947 | McDonald | 160/348 |
| 2,629,436 | A | * | 2/1953 | McDonald | 160/348 |
| 2,831,538 | A | * | 4/1958 | Lishman | 160/330 |
| 3,664,026 | A | * | 5/1972 | Lawson | 33/759 |
| 4,928,743 | A | * | 5/1990 | Wojtysiak | 160/84.01 |
| 5,186,232 | A | * | 2/1993 | Zahner | 160/330 |
| 5,769,144 | A | * | 6/1998 | Carter | 160/330 |
| 6,059,009 | A | * | 5/2000 | Haiber | 160/330 |
| 6,189,597 | B1 | * | 2/2001 | Cheng | 160/383 |
| 6,494,248 | B1 | * | 12/2002 | Zahner | 160/330 |

* cited by examiner

*Primary Examiner*—David Purol
(74) *Attorney, Agent, or Firm*—Morris E. Cohen

(57) ABSTRACT

Methods and kits for providing a consumer with the ability to easily convert an item of material into a hanging product, such as a window or shower curtain. The consumer can purchase an item of fabric to his or her liking, and use the kit for conversion of the fabric into curtains. The kit assists with and facilitates the process, providing the consumer with the ability to custom make hanging products with limited or no prior experience.

22 Claims, 4 Drawing Sheets

TEMPLATES AND KITS FOR CREATION OF HANGING PRODUCTS

RELATED APPLICATIONS

The present application claims the priority of U.S. Nonprovisional application Ser. No. 10/320,340 filed Dec. 16, 2002, U.S. Provisional Application Ser. No. 60/353,358 filed Feb. 1, 2002, U.S. Nonprovisional application Ser. No. 09/617,402 filed Jul. 17, 2000, the priority of U.S. Nonprovisional Application Ser. No. 60/143,853 filed Jul. 15, 1999, U.S. Provisional Application Ser. No. 60/217,747 filed Jul. 12, 2000, U.S. Nonprovisional application Ser. No. 09/855,201 filed May 14, 2001, U.S. Nonprovisional application Ser. No. 09/916,603 filed Jul. 27, 2001, U.S. Nonprovisional application Ser. No. 09/738,545 filed Dec. 15, 2000, U.S. Nonprovisional application Ser. No. 10/062,588 filed Jul. 5, 2001, U.S. Nonprovisional application Ser. No. 09/738,555 filed Dec. 15, 2000, U.S. Provisional Application Ser. No. 60/253,581 filed Nov. 28, 2000, U.S. Provisional Application Ser. No. 60/203,873 filed May 12, 2000, U.S. Provisional Application Ser. No. 60/171,081 filed Dec. 15, 1999, and U.S. Provisional Application No. 60/150,876 filed Aug. 26, 1999. All of those applications are hereby fully incorporated into this application by reference.

BACKGROUND OF THE INVENTION

Currently, a variety of methods and products exist for suspending material from a rod. Among them, for example, the present inventor has provided numerous inventions in the art for suspending material using an integrated support for an opening in the material. Traditionally, however, creation of such products is the domain of manufacturers working with expensive machinery, which develop and commercialize large amounts of mass produced items for the general market, in the form of finished materials of a fixed appearance and design for purchase by the consumer. Accordingly, it would be a significant benefit to provide consumers having no prior experience with the ability to easily custom make hanging materials of any appearance and design they wish from their desired materials.

SUMMARY OF THE INVENTION

It is an object of the present invention to provide methods and products for converting an item of material into a hanging product.

It is an object of the present invention to provide do-it-yourself components for converting material to hanging products.

It is an object of the present invention to provide do-it-yourself components for converting material to hanging products.

It is a further object of the present invention to provide kits for consumers for the conversion of material to hanging products.

Further objects of the invention will become apparent in conjunction with the detailed disclosure provided herein.

In accordance with the present invention, methods and kits are provided allowing a consumer the ability to easily convert an item of material into a hanging product. For example, a person can purchase an item of fabric to his or her liking, and use the kit for conversion of the fabric into curtains. The kit assists with and facilitates the process, providing the consumer with the ability to "do-yourself" even with limited or no experience. In this manner, custom-made hanging products can be easily created by the consumer for use wherever desired.

BRIEF DESCRIPTION OF THE DRAWINGS

FIG. 12(*a*) is a schematic of a double width tape and FIG. 12(*b*) is a schematic of a triple width tape, in accordance with this embodiment

DETAILED DESCRIPTION OF THE INVENTION AND THE PREFERRED EMBODIMENTS

The present invention relates to methods and products which provide consumers (e.g. individuals, home decorators, and so forth) with the ability to convert a piece of material into a hanging product in a 'do-it-yourself' fashion. Using these methods, consumers can take a material of their choice and create a hanging product having a fastener therein for suspending the material from a rod. Accordingly, window curtains, draperies, shower curtains, and any other hanging products can be easily created using the components and/or kits provided herein.

In addition, a system is provided which facilitates the measuring, cutting, and creation of a suitable opening pattern while stabilizing the fabric during preparation and use. The bonding of a tape to the fabric provides stability and body for the cutting of the material, particularly with thin or flimsy materials, such as thin fabrics. The bonding further prevents the fraying of the material during the cutting step, and prevents subsequent fraying of the material over time. During use of the hanging product, the bonded tape and integrated ring provides further structure.

Figure 1:
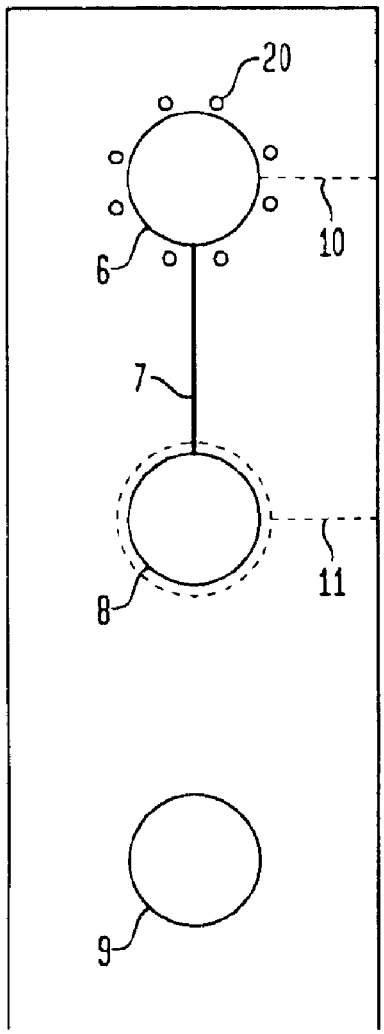
FIG. 1 is a front view of a single-width tape for use in accordance with one embodiment of the present invention.

In accordance with the invention, a template of opening patterns is provided for use by a consumer to assist the consumer in creating a hanging product, as shown for example in FIG. 1. The template is preferably in the form of a tape, although a template having only a pattern thereon can be provided (with a tape being provided separately, for example), as disclosed below.

In the preferred embodiment, the template is a tape for affixation to a material is shown in FIG. 1. The tape 16 of FIG. 1 is referred to herein as a "single-width" tape, to distinguish from the "double-width" tape 32 of FIG. 5. Using these tapes, a piece of fabric can be converted by a consumer into a shower curtain, window curtain, drapery, or other hanging article. As with the remaining components of the present invention, these tapes can be provided to the consumer as individual components or can be provided as part of a kit.

Figure 2:
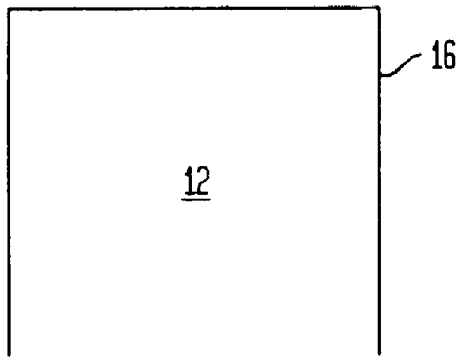
FIG. 2 is a back view of a tape for use with the embodiments of the present invention, preferably having an adhesive thereon for bonding to the desired material for hanging.
Figure 3:
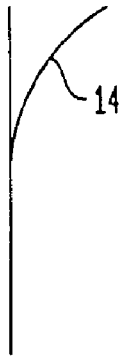
FIG. 3 is a back view of an a tape for use with the embodiments of the present invention as an alternative to the that of FIG. 2, wherein the back of the tape has a peel-off backing, for exposing an adhesive under the backing.
Figure 4:
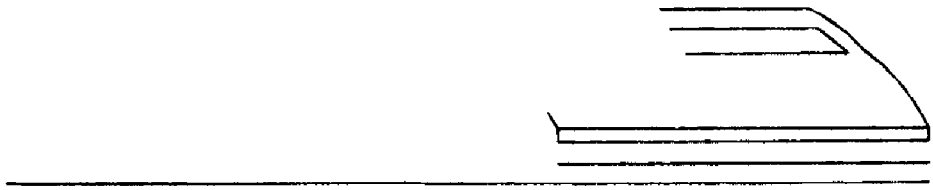
FIG. 4 is a schematic view showing heat-based affixation of the tape of FIG. 1 to a desired material in accordance with the present invention.

In accordance with the preferred embodiments of the invention, tapes 16 and 32 include a bonding material for affixation of the tape to the desired material. For example, the tape can include an iron-on adhesive or bonding agent 12 on the back, as in FIG. 2, or a peel-off backing 14 which exposes an adhesive, as shown in FIG. 3. However, in an alternate embodiment, the adhesive could be applied by the consumer.

Figure 5:
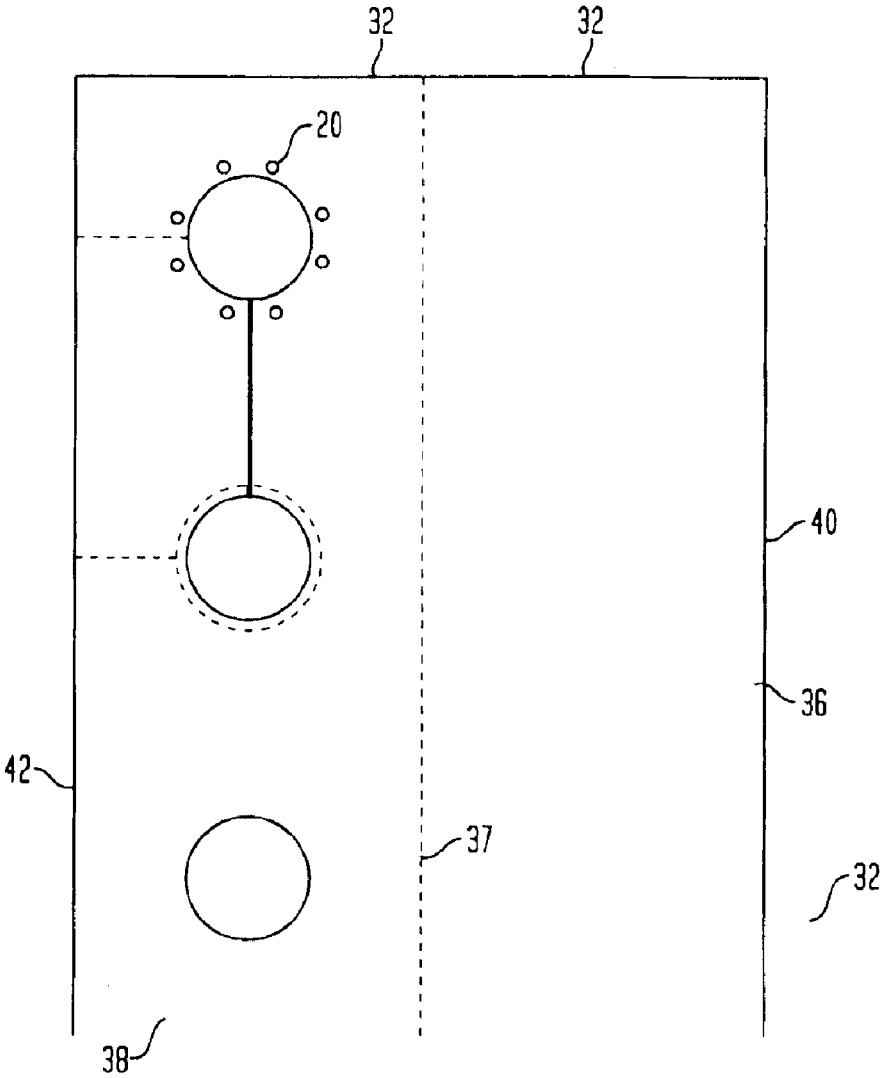
FIG. 5 is a plan view of a double-width tape for use in accordance with a further embodiment of the present invention.
Figure 6:
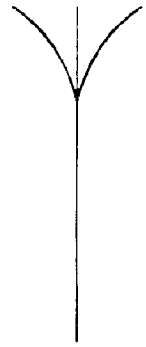
FIG. 6 is a side view of the tape of FIG. 5.
Figure 7:
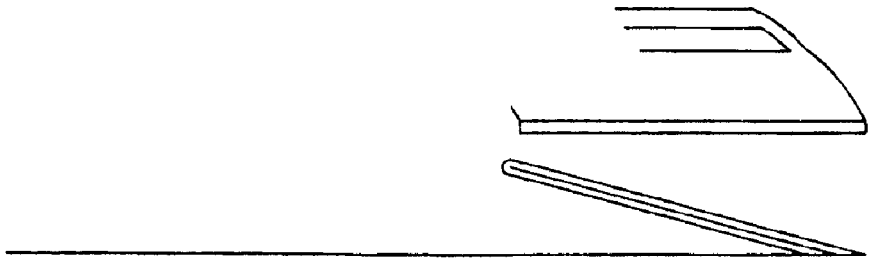
FIG. 7 is a schematic view, showing heat-based affixation of the tape of FIG. 5 to a desired material in accordance with the present invention.

The template tape 16 or 32 further includes at least one pattern imprinted thereon, as shown in FIGS. 1 and 5. The pattern provided will depend on the fastener and method to be used for creation of the product, and corresponds to the desired openings to be cut through the fabric, each of the openings to be supported by an integrated loop fastener. Any desired fasteners can be utilized, including, but not limited to, those provided in U.S. Pat. No. 5,186,232 issued on Feb. 16, 1993 (the '232 patent), U.S. Nonprovisional patent application Ser. No. 09/617,402 filed Jul. 17, 2000, or any of the other related applications listed above, the disclosures of which are all fully incorporated herein by reference. Such applications disclose numerous fasteners having a slit extending through the fastener, i.e. a slit extending from the inner circumference to the outer circumference of the fastener, allowing the fastener to be attached to a mounted rod (i.e. a rod mounted on both ends) without removing the rod from its supports. Alternatively, any other fasteners, whether grommets or so forth, can be used as well.

The pattern provided will depend on the desired fastener. For example, pairs of openings connected by a slit can be used as in the invention of the '232 patent, and as represented by openings 6 and 8 connected by slit 7 shown in FIG. 1. Alternatively, a series of openings can be used, with each opening having an external slit (a vertical slit), as represented by opening 6 and slit 10 in FIG. 1. Or, an opening for a grommet can be used, as represented by opening 9 in FIG. 1.

If desired, the tape can include a pattern corresponding to a single type of opening only, e.g. a pattern having only single holes 9; or a pattern only having markings for openings 6 with slits 10; or so forth.

Alternatively, the tape can include a pattern which include all possible opening and slit alternatives thereon, as shown by FIG. 1, including markings for 6, 7, 8, 9, 10, and 11 thereon even though only some of those elements will be used in a particular pattern and hanging method chosen by the user. Using this combined template, a user can choose whichever set of openings he or she desires. For example, the pattern allows creation of a hanging product using the method of the '232 patent by using holes 6 and 8 and slit 7. Alternatively, an "external slit pattern" can be created by using holes 6 and 8 and slits 10 and 11. A simple grommet pattern can be created by using holes 6, 8 and 9 (with no slits).

In one embodiment, the pattern is permanently affixed to the tape. In an alternate embodiment, the pattern can be removed from the tape. For example, the pattern can be on a peel-off layer which can be removed from the tape once the consumer has done the necessary cutting, so that any portions of the original pattern markings are no longer visible after the curtain has been completed. Or, the pattern can be on a perforated portion which can be ripped off of the tape. Further alternatively, the pattern can be a piece of material which is separate from the tape, and which serves as a template that is placed onto the tape before cutting. In any of the embodiments in which the pattern is not printed onto the tape, the pattern is removed after the tape is cut and before the fastener is affixed to that tape.

In accordance with one embodiment of the invention, a "single width" tape is used, as shown in FIG. 1. Before using the tape, a consumer will select a material that he or she wishes to utilize for a hanging product, and will obtain a piece of material sufficiently large for the intended purpose (e.g. to cover a window). Alternatively, as with any of the methods of the present invention, material can be provided to the user (e.g. as part of a kit with other components such as the tape and so forth). The present method can be used to create any of the hanging products in the related applications listed above, all of which are fully incorporated herein by reference. Such hanging products include items for hanging by windows, or for use in the bathroom or kitchen, and so forth. They include, but are not limited to, window curtains, draperies, shower curtains and shower closures, hanging towels (i.e. towels having fasteners for attachment via the fastener to a rod), clothing for attachment via a fastener to a rod, hanging accessories, and so forth. For illustration purposes, the invention is subsequently described herein using fabric for creation of a hanging window curtain as an example, although other hanging products can be created in like fashion. For example, shower curtains can be created out of a suitable material, whether fabric or thin pieces of vinyl, or so forth.

Once the consumer has selected the fabric and obtained a sufficiently large piece of fabric, he or she can proceed to create the hanging window curtain. In a first embodiment of the invention, using the tape of FIG. 1, step one of the method is for the consumer to attach the tape 16 to the fabric. Preferably, tape 16 is attached to die fabric's upper back edge, i.e. the upper edge of the fabric that will be adjacent to the ceiling but facing away from the consumer when the fabric is eventually a curtain (i.e. the side of the curtain toward the window such that it is hidden from view). Preferably, the consumer bonds the tape to that upper edge using the adhesive means provided on the tape, whether by ironing it on, removing a peel-off backing, or so forth. Alternatively, the consumer can apply the adhesive herself, or be provided with the tape and adhesive separately, or so forth.

This tape can be used with any of the opening patterns discussed above, and with any integrated fastener of FIGS. 9–11 (or with any other suitable fastener). The fastener of FIG. 9 includes two interlocking rings which mechanically lock together using pins and matching openings in a mating male-female relationship. The fastener of FIG. 10 includes a ring with a raised radius which is affixed to the fabric via adhesive (whether adhesive preapplied onto the fastener and/or tape, or adhesive applied by the user). The fastener of FIG. 11 includes a simple grommet. Both the rings of FIGS. 9 and 10 have a slit 26 therein (preferably precut), and are provided for use with the '232 pattern or external slit pattern. The fastener of FIG. 11 has no slit therein and is intended for use as a simple ring that is threaded onto a rod, as with traditional curtain fasteners that are well known in the art.

Once the tape has been firmly affixed to the fabric, the consumer proceeds to step two of the method, namely, the cutting of holes in the tape and the curtain material. Various different openings are possible, as described above, whether a pattern corresponding to the '232 patent or to the external slit, or so forth.

In the step two of the method, the consumer takes a cutting tool and cuts the desired holes in the fabric (and any slits that may be applicable) using a cutting tool. One suitable cutting tool is shown by tool 50 in FIG. 8(*a*). Cutting tool 50 includes a handle on top and a circular razor blade on bottom. The consumer places this cutting tool 50 against the tape (which is now attached to the fabric) and onto one of the opening patterns such as opening 6. The consumer then presses the tool 50 against the hole or presses and rotates the tool to cut a hole out of the tape and attached fabric. Alternately, a large hole punch can be used, such as those used for cutting paper in a preferred embodiment, the tools needed are provided in a kit along with the preprinted tape and fasteners. If desired, one or more sizes of cutting tools can be provided (e.g. with corresponding tapes), so that the consumer can cut hole in the curtain corresponding to the size needed for the particular use.

Figure 8A:
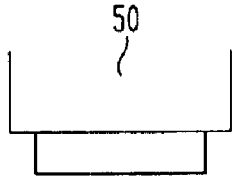
FIGS. 8(*a*), 8(*b*) and 8(*c*) are schematic views of various cutting tools for use with the present invention.
Figure 8B:
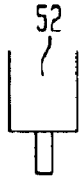
Figure 8C:
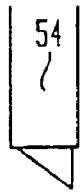

If the consumer has chosen to use an integrated fastener with pins (as in FIG. 9), he or she can also use a cutting tool 52 as shown in FIG. 8(*b*). Cutting tool 52 is similar to cutting tool 50 but is designed with a smaller blade to allow the cutting of smaller holes in the fabric.

If the consumer has chosen a pattern with slits therein, he or she can cut that slit using cutting tool 54. Cutting tool 54 is a handle with a straight blade extending therefrom as shown in FIG. 8(*c*). Using this tool, the consumer can cut slits 10 and 11 (or slit 7) into the tape and fabric.

While several tools are shown for illustration purposes, it will be understood that any suitable tools can be used by the consumer as needed (and provided in the kit if desired), consistent with the invention. For example, the consumer can use a straight edge (e.g. a ruler), a tool for hammering down a half of a grommet into its other half (or a tool for clamping together two halves of a grommet), an iron, a razor, a scissor, and so forth.

Once the holes (and any desired slits) have been cut out of the taped fabric, the consumer can proceed to step three, placement of the rings or fasteners onto the holes.

Figure 9A:
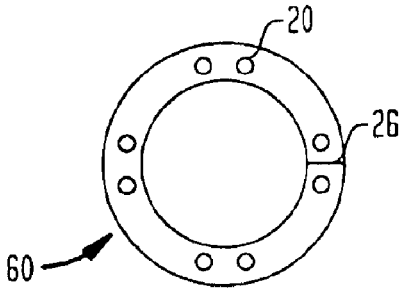
FIG. 9 is illustrates one embodiment of a fastener for use with the present invention, with FIG. 9(*a*) being a first half of the fastener, and FIG. 9(*b*) being a second half.
Figure 9B:
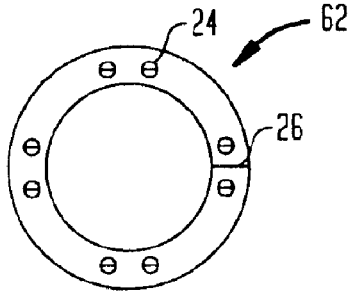

Various integrated loop fasteners can be provided for use with the holes. For example, a set of interlocking rings 60 and 62 can be used as shown in FIG. 9. Ring 60 has a series of pins 20 on it which are placed in positions corresponding to that of holes 24 of ring 62. When rings 60 and 62 are pressed together (with the taped fabric between them as discussed below), the pins lock into the holes (e.g. by friction fit or snapping in) to secure the rings together.

Figure 10A:
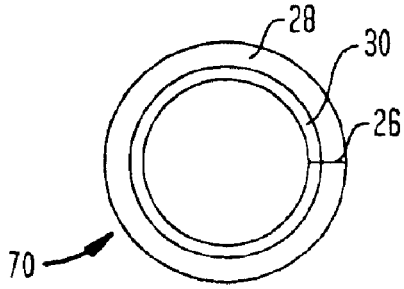
FIG. 10 illustrates a further embodiment of a fastener for use with the present invention with FIG. 10(*a*) being a front view of the fastener and FIG. 10(*b*) being a back view.
Figure 10B:
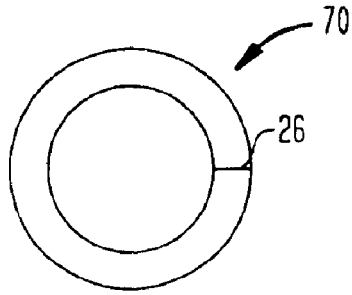

Another possible fastener is shown in FIG. 10. Ring 70 is a single ring, the front side being shown as FIG. 10(*a*) and the back side as FIG. 10(*b*). A strong adhesive is provided on the ring at surface 28. In addition to this surface, the ring includes a raised radius 30 which is higher than surface 28. When the ring 70 is being attached to the fabric, the raised radius 30 assists with placement. Specifically, the taped fabric (having the holes punched out) is placed onto the ring 70, with the raised radius extending through the hole in the tape and the fabric resting on surface 28. Thus; the hole in the fabric is easily positioned onto the ring by placing the hole in the fabric onto the raised radius 30, such that the fabric is around that raised radius. In addition, the radius ensures that the hanging product slides on the ring, rather than the fabric, to move smoothly along the rod.

Figure 11A:
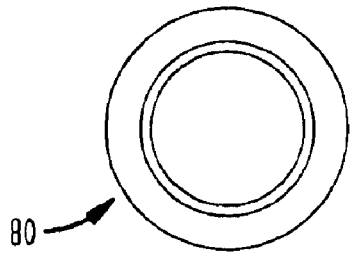
FIG. 11 illustrates yet a further embodiment of a fastener for use with the present invention with FIG. 11(*a*) being a first half of the fastener, and FIG. 11(*b*) being a second half.
Figure 11B:
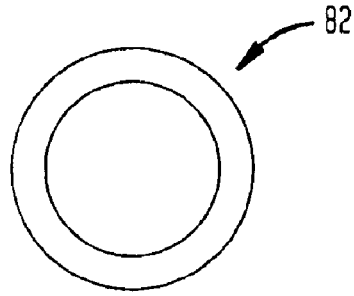

A third possible fastener is shown in FIG. 11. The fastener of FIG. 11 is a standard grommet ring as traditionally used in the art of making curtains. It consists of two halves, 80 and 82, which snap or lock together in any desired fashion. The fastener of FIG. 11 specifically differs from that of FIGS. 9 and 10 in that no slit 26 is provided therein. Any of the fasteners of FIGS. 9–11, or any other desired fastener can be used, consistent with the invention.

In step three of the invention, the desired fastener is placed onto the holes and affixed thereto, whether by clamping two interlocking rings together (as with the rings of FIGS. 9 and 11), or by adhering the ring to the tape (as with the ring of FIG. 10).

If the ring is for attachment to one side of the curtain only (via adhesive), it can be attached either to the front or the back of the curtain. The ring is adhered or otherwise attached to the back of the curtain. Preferably, it is adhered directly to the tape (which is itself adhered to the back of the fabric), so that the ring is not visible when the curtain is hung. In this case, the adhesive placed on the ring can be adhered more readily to a standardized surface tape. Or, adhesive can be placed on the tape conforming to the shape and location of where the ring is to be placed.

Alternatively, if the ring is for attachment to one side of the curtain, it can be adhered or otherwise attached to the front of the curtain. In this case, a decorative ring can be used if desired, to further enhance the appearance of the front of the curtain to the consumer. Or, if the embodiment is used with two interlocking rings, the rings are attached through the curtain, such that one ring is located on the back of the curtain and one ring is located on the front.

Once the ring has been attached to the fabric, the top of the fabric is complete and ready for hanging. The fabric now has an integrated fastener therein at its top surface that will slide along a rod.

In a further embodiment of the invention, a "double width" tape 32 can be used as shown in FIG. 5. Double-width tape 32 includes a top half 36 which is preferably blank of patterns, and a bottom half 38 having an opening pattern thereon, with a line or perforation 37 between the top and bottom halves. In this embodiment of a double width tape (as opposed to a single width), the top half of the tape is the portion adhered to the fabric in the preferred embodiment, the top half is provided with an adhesive backing, while the bottom half is adhesive-free. Both the front and back of the top half are provided with the adhesive. Although prior application of the adhesive to the tape is more convenient to the user, it will be understood, of course, that alternatively, the consumer could apply the adhesive directly to the tape or to the fabric himself.

In accordance with the method of the invention, the double width tape 32 is placed on the fabric of choice. For illustration purposes, the present example assumes that the tape is 8 inches from top to bottom, with perforation 37 provided in the center, i.e. 4 inches from the top edge 40 and four inches from the bottom edge 42.

In the first step of the method, the double width tape is placed onto the fabric. The tape is placed such that top edge 40 of the tape is placed parallel to the top edge of that fabric. The tape is placed with the top edge of the tape below the top edge of the fabric at a distance equivalent to the distance between the top edge of the tape and the tape's perforation (i.e. a distance equivalent to half the total width of the tape).

In other words, in the present example the top edge 40 of the tape would be positioned four inches below the top edge of the fabric, with the bottom edge 42 of the tape located twelve inches below the fabric's top edge.

In the second step of the invention, the top four inches of fabric (i.e. the fabric from its top edge until the beginning of the tape) is folded over and down onto the tape, so that four inches of fabric now cover the top half 36 of tape 32.

At the appropriate step of the method, the tape is bonded to the fabric. For example, if the tape uses a peel-off backing, the peel-off backing is removed prior to step one, to expose the adhesive for adherance of the tape to the fabric. If the tape uses an heat-activated adhesive (iron-on), then the tape is bonded to the fabric at the end of step two, once the fabric has been folded over. Whichever adhesive type is used, the adhesive is preferably located on both the back and front of top half 36 (back and front), to adhere both sides of the top portion of the tape to the fabric.

After the top half of the double width tape has been securely adhered to the fabric, the template on the bottom half of the tape is superimposed onto the fabric and used to cut out the pattern. In this third step of the method, the bottom half 38 is now folded up and over onto the fabric which is bonded to the tape. This bottom half of the tape has a series of potential cut-out patterns on it, as previously described above with respect to the single width tape. If desired, the bottom half 38 can be temporarily pinned or dipped in place on the tape bonded fabric.

Steps one and two, therefore, provide a "sandwich" having fabric on the outside and tape on the inside, the fabric and tape preferably being bonded together. This sandwich is created prior to the cutting of the pattern in the fabric. The tape on the inside of this "sandwich" provides structure to the fabric, making it less likely to fray or rip. This increased stability and structure is especially useful for fabrics which are thin, delicate, gauzy, or so forth. Step three subsequently positions a template onto this "sandwich" for the cutting of the pattern in step four.

If desired, the top half 36 and bottom half 38 can provided as individual pieces, such that two (or more) separate strips of tape are used. However, it is preferred that one tape is utilized and folded over as described with respect to step three. Likewise, while a single width or double width tape is preferred, a triple or greater width tape can also be used consistent with the invention, as discussed above.

Once the bottom half or template 38 is in place, the desired pattern can be cut in step four out of the fabric-tape-fabric "sandwich", in the same manner as discussed above with respect to the single width tape, and using the same types of tools, or any other suitable implements. Then, when the desired pattern has been cut out, the template 38 is no longer needed and can be ripped or cut off at the perforation 37.

After the cuts have been made in the sandwich, a fastener is secured to the sandwich in step five to reinforce the holes in the fabric, as previously discussed with respect to the single width tape. In these double width or triple width tape embodiments (or so forth), the fasteners can similarly also be of the '232 type, the external slit variety, or so forth. Once the fastener has been attached, the top of the curtain or other hanging product is complete and the material is ready for hanging.

Figure 12A:
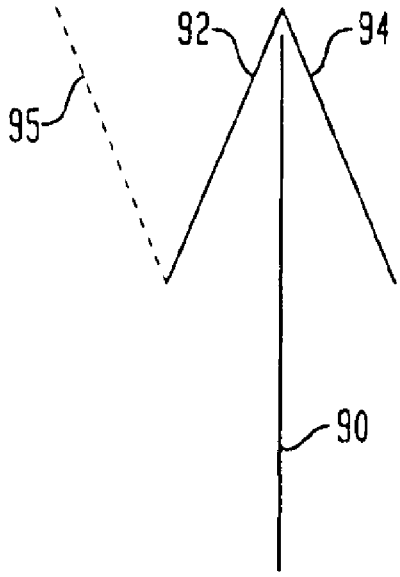
FIG. 12 illustrates a further embodiment of the invention in which the tape is folded over the front of the hanging material for decorative purposes.
Figure 12B:
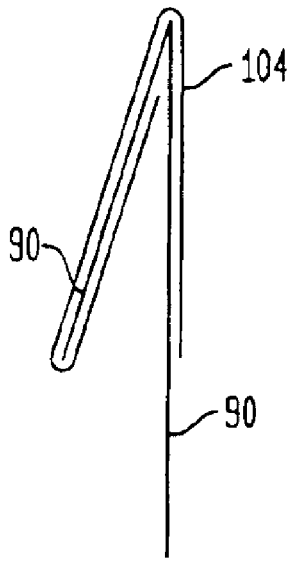

In additional or alternative embodiments of the invention, instead of being applied to the back of the curtain only, the tape can be applied to the front as well, as shown in FIGS. 12(*a*) and 12(*b*). FIG. 12(*a*) illustrates a sample double-width product and method wherein the bottom portion 92 of the tape is applied at the back of the material provided for making the hanging product 90 (e.g. fabric for a curtain), with the top portion 94 of the tape being applied to the front of the material. The bottom portion of the tape can, for example, have a tear off or a peel off pattern 95. FIG. 12(*b*) shows a sample triple width product and method, which likewise has a top portion 104 of the tape affixed to the top front of the material 90, with a bottom portion of the tape adhering to and sandwiching a folded over portion of fabric on the top back of the hanging product. This embodiment yet further stabilizes the top of the fabric from fraying, such that a total of three layers of tape and two layers of fabric result on the top of the hanging product.

Further alternatively, in a non-preferred embodiment, a pattern of desired openings and/or slits can be pie-cut into the tape if desired, eliminating the need for the consumer to cut those patterns. In this embodiment, the holes (and any slits if needed) are already cut into the tape, such that the user can affix a tape with holes in it to the fabric. In this embodiment, the cutting steps above involve a cutting through the hanging material only, at the locations already cut out of the tape template.

In a further embodiment of the invention, the tape can be partially attached to the top edge of the hanging material (whether by bonding or sewing etc), and can partially extend above the top of that hanging material, e.g. with the template on that tape whether on or above the hanging material. Similarly, in the various embodiments previously discussed, components can be sewn together instead of adhering them with adhesive, or so forth.

Likewise, although a variety of methods have been presented herein, any other suitable method consistent with the invention can be used as well.

Accordingly, methods and systems are provided herein which makes it possible for a consumer to easily and simply create a hanging product, such as a window curtain or so forth, out of any desired material. Furthermore, the system facilitates the measuring, cutting, and creation of a suitable opening pattern while preventing fraying of the fabric material, by the use of a tape and ring combination, as discussed above. Preferably, combinations of the necessary components are provided in kit form, such that the consumer is provided with some or all of the necessary materials to easily custom make desired hanging products, preferably along with a set of instructions directing the consumer in one or more methods for creating the product using those components and a desired material for hanging. Generally, the material to be hung will be purchased by the consumer separately from purchase of the kit to allow the consumer a maximum selection of fabric or other material. Alternatively, however, the material can be included in the kit as well such that an "all-in-one" kit is available with everything needed being provided therein. Or, instead of a kit a series or system of components can be provided for the consumer to mix and match, according to the needs of the specific project to be conducted. As discussed above, examples of such components, include tapes and patterns (whether the pattern is separate or provided on the tape), fasteners, instructions, tools, and so forth.

Having described this invention with regard to specific embodiments, it is to be understood that the description is not meant as a limitation since further modifications and variations may be apparent or may suggest themselves. It is intended that the present application cover all such modifications and variations.

What is claimed is:

1. A method comprising the steps of:

(a) providing at least one component for use by a consumer, said at least one component being provided for assisting the consumer in creating a hanging product out of an item of material, wherein the hanging product is a product suitable for suspension from a mounted rod;

(b) said at least one component comprising at least one tape for use by the consumer in creating the hanging product said tape being provided for affixation by the consumer to the item of material;

(c) said at least one component also comprising a pattern, wherein said pattern comprises markings, said markings being for use by the consumer to cut the item of material to create the hanging product, said markings of said pattern comprising at least one opening and at least one slit.

2. A method as claimed in claim 1, wherein said pattern is provided on said tape.

3. A method as claimed in claim 1, wherein said pattern is separate from said tape.

4. A method as claimed in claim 1, wherein the hanging product is a window curtain.

5. A method as claimed in cairn 1, wherein the hanging product is a shower curtain.

6. A method as claimed in claim 1, wherein the hanging product is drapery.

7. A method as claimed in claim 1, wherein said pattern further comprises markings for a series of said opening and said slits.

8. A method as claimed in claim 1, wherein the item of material is included in the kit.

9. A method as claimed in claim 1, further comprising the step of providing a fastener for attachment to the openings cut by the consumer in the item of material.

10. A method comp sing the steps of:

(a) providing a series of components for use by a consumer, said components being provided for assisting the consumer in creating a hanging product out of an item of material, wherein the hanging product is a product suitable for suspension from a mounted rod;

(b) said components comprising at least one tape for use by the consumer in creating the hanging product, said tape being provided for affixation by the consumer to the item of material;

(c) said components comprising a at least one pattern, wherein said pattern comprises markings corresponding to at least one opening and at least one slit for the consumer to cut out of the item of material to create a hanging product from the item of material; and, (d) said components further comprising at least one fastener for use by the consumer in creating the hanging product, said fastener being provided for attachment to the item of material.

11. A method as claimed in claim 10, further comprising the step of providing a set of instructions, said instructions directing the consumer in at least one method for creating a hanging product from the item of material.

12. A method as claimed in claim 10, wherein said kit components further comprises at least one tool for use in creating the hanging product.

13. A method as claimed in claim 10, wherein said components are provided for use in creation of a window treatment.

14. A method as claimed in claim 10, wherein said components are provided for use in creation of a shower curtain.

15. A method as claimed in claim 10, wherein said components are provided for use in creation of drapery.

16. A method as chimed in claim 10, wherein said tape is provided for attachment to the item of material.

17. A method as claimed in claim 10, wherein said tape is provided with a pattern of markings for a series of said openings.

18. A method as claimed in 17, wherein said pattern further comprises markings for a series of said slits.

19. A method as claimed in claim 10, further comprising providing the item of material.

20. A method as claimed in claim 10, wherein said fastener comprises an inner circumference, an outer circumference, and a slit extending for the said inner circumference of said fastener to said outer circumference to allow said fastener to be attached to a rod mounted on both ends without removing the rod from its supports.

21. A method, comprising:

(a) providing a first component and a second component for use by a consumer, said components being provided for assisting the consumer in creating a hanging product from an item of material wherein the hanging product is a product suitable for suspension from a mounted rod;

(b) said first component comprising a tape for use by the consumer in creating the hanging product, said tape being provided for affixation by the consumer to the item of material;

(c) said second component comprising a pattern, said pattern being separate from said tape, said pattern comprising markings, said markings being for use by the consumer to assist in cutting the item of material to create the hanging product, said markings of said pattern comprising at least one opening.

22. A method as claimed in claim 21, wherein said pattern comprises a series of openings.

* * * * *